US007300000B2

(12) United States Patent
Kitamura et al.

(10) Patent No.: US 7,300,000 B2
(45) Date of Patent: Nov. 27, 2007

(54) INTERNAL CLEANING APPARATUS

(75) Inventors: Takahito Kitamura, Kanazawa (JP); Takahisa Tsukamoto, Kanazawa (JP); Taketoshi Fujii, Kanazawa (JP)

(73) Assignee: Shibuya Machinery Co., Ltd., Ishikawa (JP)

( * ) Notice: Subject to any disclaimer, the term of this patent is extended or adjusted under 35 U.S.C. 154(b) by 0 days.

(21) Appl. No.: 11/481,852

(22) Filed: Jul. 7, 2006

(65) Prior Publication Data

US 2007/0007365 A1 Jan. 11, 2007

(30) Foreign Application Priority Data

Jul. 7, 2005 (JP) ..... P2005-198630

(51) Int. Cl.
*B05B 3/00* (2006.01)

(52) U.S. Cl. ..... 239/263.1; 239/237; 239/227; 239/291; 239/419.5; 239/380; 239/425.5; 134/166 R

(58) Field of Classification Search ..... 239/380, 239/225.1, 240, 237, 263.2, 291, 419.5, 424, 239/425.5, 428.5, 160, 263.1, 227; 134/166 R, 134/167 R See application file for complete search history.

(56) References Cited

U.S. PATENT DOCUMENTS 506,879 A * 10/1893 Jewell ..... 210/179
3,001,534 A * 9/1961 Grant, Jr. ..... 134/167 R
3,460,988 A * 8/1969 Kennedy, Jr. et al. ..... 134/1
4,690,325 A * 9/1987 Pacht ..... 239/124

FOREIGN PATENT DOCUMENTS

| | | |
|---|---|---|
| JP | 63-2145 U | 1/1988 |
| JP | 6-94128 B2 | 11/1994 |
| JP | 2004-223409 A | 8/2004 |

* cited by examiner

*Primary Examiner*—Dinh Q. Nguyen
(74) *Attorney, Agent, or Firm*—Sughrue Mion, PLLC

(57) ABSTRACT

An internal cleaning apparatus includes a rotary shaft which, having a liquid flow passage, is provided so as to be axially rotatable, a revolving rotary shaft which, having a liquid flow passage connected to the liquid flow passage and being provided in a direction substantially perpendicular to the rotary shaft, is installed so as to be revolvable about the rotary shaft and axially rotatable, and a nozzle provided at a leading end of the revolving rotary shaft, wherein a gas flow passage is provided along the liquid flow passage of each of the rotary shaft and the revolving rotary shaft from a gas inflow opening provided in the rotary shaft, wherein a configuration is such as to eject a gas-liquid mixture flow having a gas supplied from outside the object to be cleaned mixed with the liquid ejected from the nozzle.

6 Claims, 4 Drawing Sheets

INTERNAL CLEANING APPARATUS

This application is based on Japanese Patent Application No. 2005-198630, which is incorporated herein by reference.

BACKGROUND OF THE INVENTION

1. Field of the Invention

The present invention relates to an internal cleaning apparatus for cleaning an interior of an object to be cleaned, such as a tank or a stack, which has an internal space.

2. Description of the Related Art

As a related art of this kind of internal cleaning apparatus, an internal cleaning apparatus has been widely known wherein a cleaning nozzle is affixed to a revolving rotary shaft configured to be revolvable about a cleaning supply pipe and axially rotatable, wherein the nozzle portion is inserted in an internal space of an object to be cleaned, and a cleaning is carried out as a cleaning liquid is three-dimensionally sprayed by causing the nozzle to revolve around the cleaning liquid supply pipe while revolving about the revolving rotary shaft (JP-UM-B-63-2145 and JP-B-6-94128). Also, a cleaning apparatus, whose cleaning action has been enhanced by using a gas-liquid mixture flow ejected by mixing a liquid and a gas, has also been developed (JP-A-2004-223409).

SUMMARY OF THE INVENTION

Bearing in mind such existing technological conditions as described heretofore, the invention has been developed with an object of providing an internal cleaning apparatus which can three-dimensionally clean an interior of an object to be cleaned having an internal space, and which, by enhancing the cleaning action, is improved in such a way that a reliable cleaning effect can be obtained in every corner.

In order to solve the problem described heretofore, in the invention, technical means is employed wherein an internal cleaning apparatus comprises a rotary shaft having a liquid flow passage and being axially rotatable, a revolving rotary shaft having a liquid flow passage connected to the liquid flow passage of the rotary shaft, being provided in a direction substantially perpendicular to the rotary shaft, and being revolvable about the rotary shaft and axially rotatable; a nozzle being provided at a leading end of the revolving rotary shaft for ejecting a liquid, which is supplied from the liquid flow passage of the revolving rotary shaft, while revolving around the revolving rotary shaft, and a gas flow passage being provided along the liquid flow passage of each of the rotary shaft and the revolving rotary shaft from a gas inflow opening provided in the rotary shaft, wherein a gas-liquid mixture flow having a gas supplied from outside an object to be cleaned mixed with the liquid is ejected from the nozzle. It is also acceptable to configure in such a way that the nozzle is provided so as to be able to enter and retract from an interior of an internal space of the object to be cleaned, and a lid closes an opening of the object to be cleaned when the nozzle has entered the interior of the internal space. It is also acceptable to configure in such a way that the nozzle is oriented in a direction of the opening of the object to be cleaned when the nozzle is not revolving. As the nozzle, it is also acceptable to employ a smooth nozzle which is flattened in a direction parallel to the revolving rotary shaft.

According to the invention, it is possible to obtain the following advantageous effects:

(1) A three-dimensional spraying operation is possible with respect to the internal space of the object to be cleaned.

(2) Because a gas-liquid mixture flow is employed as a cleaning medium, as a cleaning action is significantly enhanced and, moreover, a wide nozzle spraying range can be covered, the cleaning action spreads reliably into every corner of the internal space of the object to be cleaned.

(3) As a gas such as air which forms the gas-liquid mixture flow is supplied from an exterior, as well as being able to obtain an efficient cleaning effect without any infiltration of a foreign substance such as scourings, it is possible to avoid damage to the apparatus by the foreign substance and obtain a more stable cleaning action.

(4) With a configuration wherein the lid closes the opening of the object to be cleaned when the nozzle has entered the interior of the internal space of the object to be cleaned, it is easily possible to block an effect on the exterior.

(5) In the event that a smooth nozzle which is flattened in a direction parallel to the revolving rotary shaft is employed as the nozzle, it is possible to obtain a particularly efficient cleaning action.

DETAILED DESCRIPTION OF THE PREFERRED EMBODIMENTS

The invention can be widely applied as an internal cleaning apparatus for an object to be cleaned, such as a tank or a stack, which has an internal space. As a cleaning liquid, it is possible to use not only ordinary water and hot water, but also a liquid with an appropriate cleaning agent added thereto and, in a case of tough dirt, a liquid with particles of abrasive blasting material or the like mixed thereinto. Also, as a gas which is mixed with the cleaning liquid to form a gas-liquid mixture flow, it is possible to use, in addition to air, a gas appropriate to its application. Incidentally, regarding the method of supplying the gas, it is acceptable to configure in such a way that the gas is sucked by an ejector action of a liquid ejected from a nozzle, that the gas is pumped from an exterior, or that both the configurations are combined. Regarding also the nozzle which ejects the gas-liquid mixture flow, so long as it is adaptable to the internal space of the object to be cleaned, there is no more particular limitation, but by employing a smooth nozzle which is flattened in a direction parallel to the revolving rotary shaft, it is possible to obtain an efficient cleaning action.

EMBODIMENT

Figure 1:
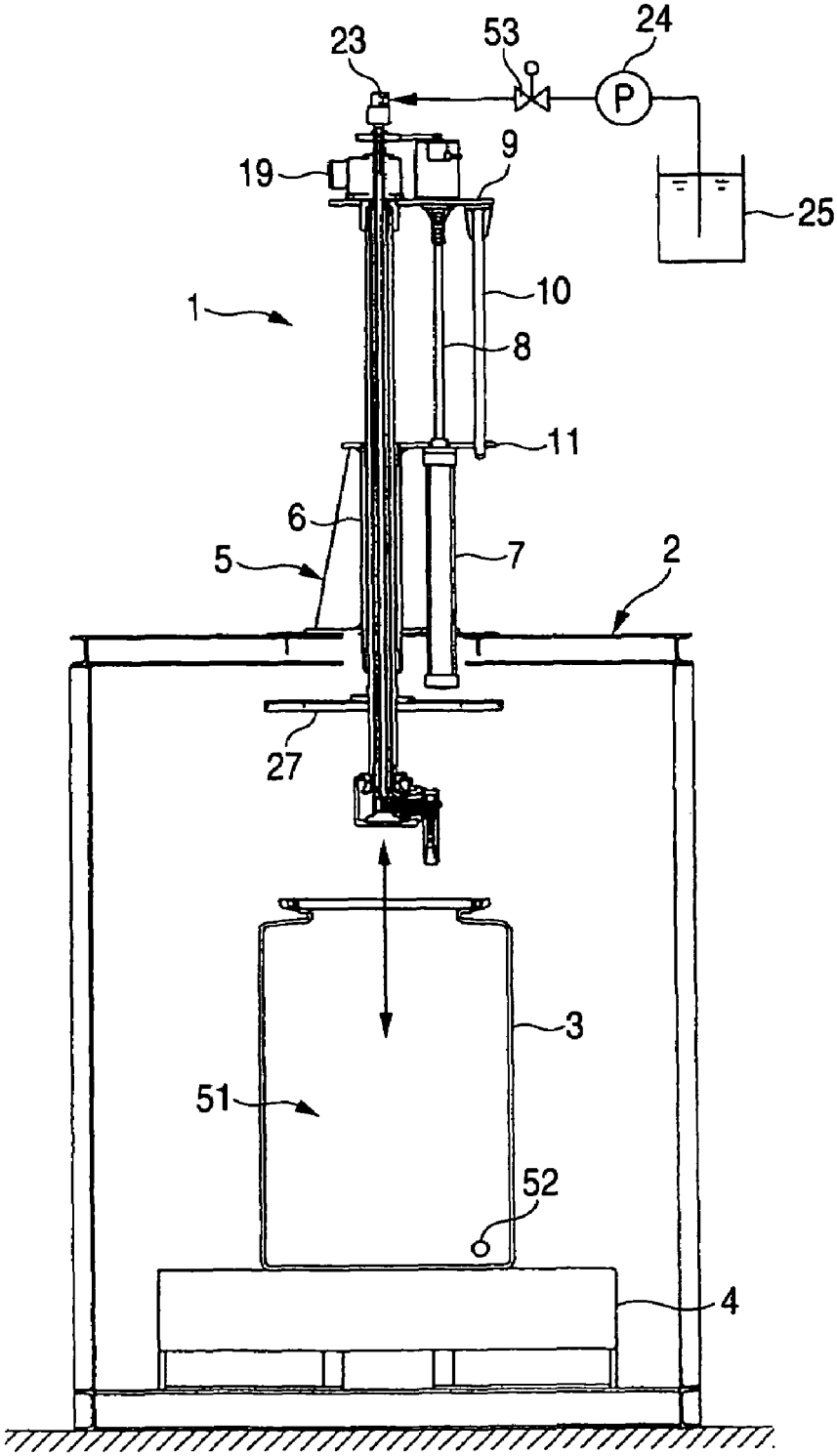
FIG. 1 is an overall configuration view showing an embodiment of the invention.
Figure 2:
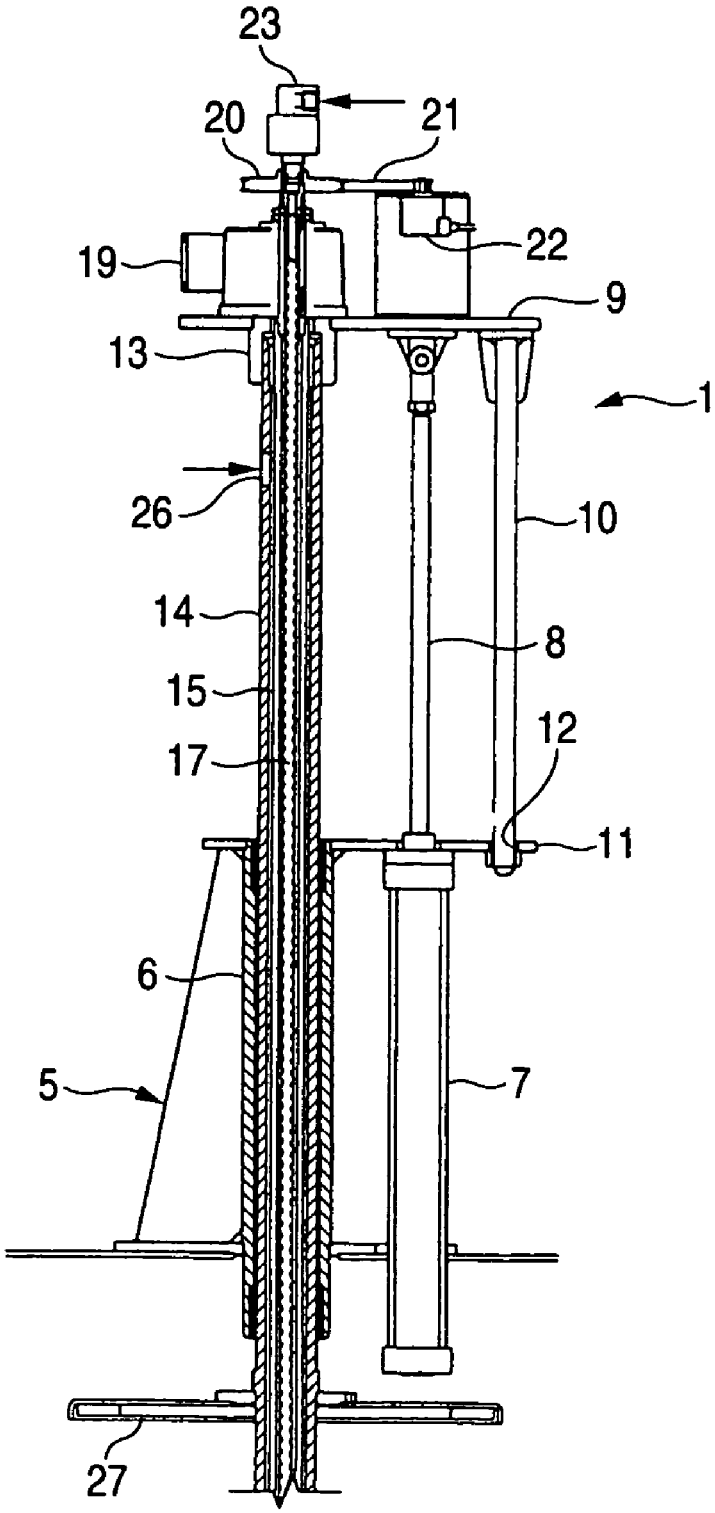
FIG. 2 is an enlarged view of a main portion of the embodiment.

FIGS. 1 and 2 show an embodiment of the invention, wherein FIG. 1 is an overall configuration view, and FIG. 2 is an enlarged view of a main portion. Reference numeral 1 in the figures depicts an internal cleaning apparatus, which is disposed on a pedestal 2. A configuration is such that an object to be cleaned 3 such as a tank is conveyed via a conveyor 4 into a prescribed position inside the pedestal 2 and, after being subjected to a desired internal cleaning, is conveyed out. The internal cleaning apparatus 1 is configured to be slidably guided by a tubular guide 6 of a support frame 5 installed on the pedestal 2, and moved up and down via a drive cylinder 7. A lift 9 is installed at a leading end of an output shaft 8 of the drive cylinder 7, wherein a configuration is such that the internal cleaning apparatus 1 can be moved up and down by supporting it on the lift 9. Reference numeral 10 in the figures depicts a guide rod which is installed in order to smooth an up-and-down movement of the internal cleaning apparatus 1, being configured to move up and down while inserted through an insertion hole 12 formed in an upper plate 11 of the support frame 5, and thereby prevent a fluctuation in the relative position of the internal cleaning apparatus 1 and the drive cylinder 7.

The internal cleaning apparatus 1 has an outer pipe 14, an upper end of which is fixed to the lift 9 via a fixture 13, and a rotary shaft 15 supported inside the outer pipe 14 so as to be axially rotatable, that is, rotatable around its axis. As shown in the partial enlarged view in FIG. 3, an inner pipe 16 is also installed inside the rotary shaft 15, and the interior of the rotary shaft 15 is divided by the inner pipe 16 into two portions: an inner portion and an outer portion, wherein a liquid flow passage 17 which supplies the cleaning liquid is formed in the inner portion, while a gas flow passage 18 is formed in the outer portion. As shown in FIGS. 1 and 2, an upper portion of the rotary shaft 15 extends upward passing through the fixture 13, wherein a configuration is such that a motor 19 applies a rotating force to a halfway point thereof, and the rotation is transmitted to an encoder 22 via a pulley 20 and a belt 21, wherein a configuration is such that a nozzle stop position can be controlled by detecting a rotation angle. Furthermore, as shown in FIG. 1, a pump 24 and a cleaning liquid tank 25 are connected to an upper end of the rotary shaft 15 by way of a rotary joint 23, wherein a configuration is such that the cleaning liquid is supplied via the liquid flow passage 17 in the inner pipe 16. Also, as shown in FIG. 2, an inflow opening 26, through which a gas such as the air flows in, is formed in an upper portion of the outer pipe 14. Furthermore, a lid 27, which closes an opening of the object to be cleaned 3 when the outer pipe 14 moves down, is affixed to a lower portion of the outer pipe 14. Instead of fixing the lid 27 to the outer pipe 14, for example, by installing a retainer in a lower portion of the outer pipe 14, it is possible to configure in such a way that the lid 27 is mounted on the retainer so as to be relatively movable. Also, by providing a support member separately from the outer pipe 14, it is possible to configure in such a way that the lid 27 is supported by the support member so as to be movable up and down. In these cases, when the outer pipe 14 is moved down to cause a nozzle portion to enter the interior of the internal space of the object to be cleaned 3, even after the lid 27 abuts against the periphery etc. of the opening of the object to be cleaned 3 in the process and closes the opening, it becomes possible to change the height of a nozzle by moving the outer pipe 14 down further, and also to clean the object to be cleaned 3 while moving up the nozzle. Furthermore, in these cases, with a configuration which provides urging means such as a spring above the lid 27, it becomes possible to more reliably maintain a condition in which the lid 27 closes the opening of the object to be cleaned 3.

Figure 3:
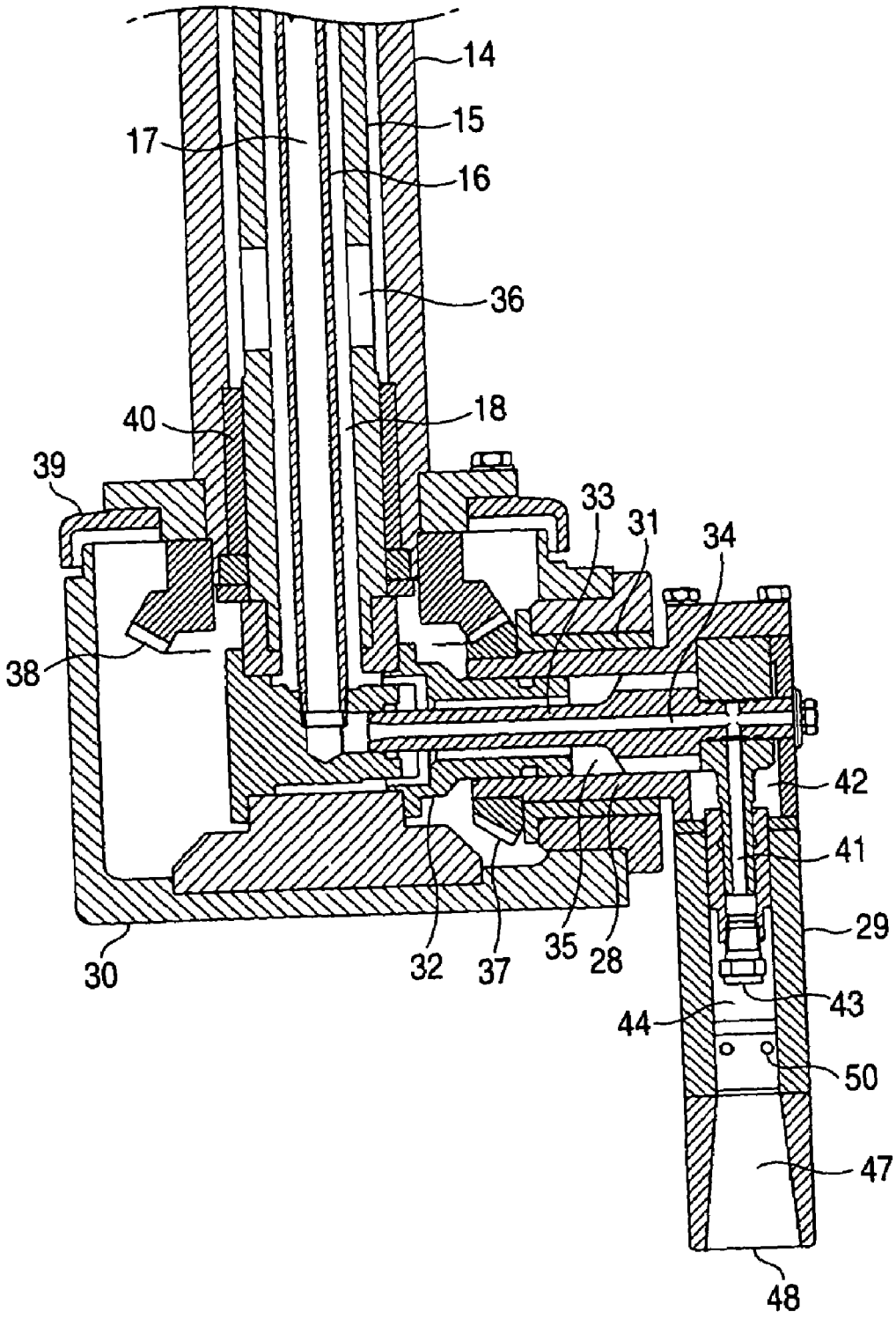
FIG. 3 is a partial enlarged view of the embodiment.

As shown in FIG. 3, at a lower end of the rotary shaft 15, a hollow revolving rotary shaft 28 is provided in a direction substantially perpendicular to the rotary shaft 15 so as to be revolvable about the rotary shaft 15 and axially rotatable, and the nozzle 29 is provided at a leading end of the revolving rotary shaft 28. The outer periphery of the revolving rotary shaft 28 is axially rotatably supported by a metal bearing 31 installed on a substantially box-like connection support member 30 which is integrally affixed to a lower end of the rotary shaft 15. Also, the inner periphery of the revolving rotary shaft 28 is fitted onto and axially rotatably connected to a tubular connection member 32 which is integrally affixed to a lower end of the rotary shaft 15. Furthermore, an inner pipe 33 connected to the inner pipe 16 is installed inside the revolving rotary shaft 28, wherein a liquid flow passage 34 and a gas flow passage 35 are formed respectively inside and outside the inner pipe 33. In the embodiment, a gas such as the air, which is supplied from the exterior, flows into a gap between the outer pipe 14 and the rotary shaft 15 via the inflow opening 26 shown in FIG. 2, further flows into the gas flow passage 18 between the rotary shaft 15 and the inner pipe 16 via a gas inflow opening 36 which is formed in a lower portion of the rotary shaft 15 as shown in FIG. 3, and is then supplied to the nozzle 29 by way of the gas flow passage 35 between the inner pipe 33 and the connection member 32 to the revolving rotary shaft 28. The position of formation of the gas inflow opening 36 may be changed to any position on the rotary shaft 15. Also, a bevel gear 37 is provided at an inner end of the revolving rotary shaft 28, and is placed in meshing engagement with a bevel gear 38 installed on the outer pipe 14, wherein a configuration is such that, as the revolving rotary shaft 28 revolves about the rotary shaft 15, the revolving rotary shaft 28 rotates axially accordingly. Furthermore, a slight gap is provided in a lower end portion of the outer pipe 14 between the outer pipe 14 and the connection support member 30, where an cover member 39 is affixed so as to cover the bevel gear 38, and an almost closed, substantially box-like space is formed by the connection support member 30 and the cover member 39, thus protecting the meshing engagement of the bevel gears 37 and 38 inside the space. Incidentally, the gear ratio of the bevel gears 37 and 38 is set in such a way that the orientation of the nozzle shifts slightly with each revolution of the rotary shaft 15. Also, it is also possible to employ a drive method by a motor in place of the bevel gears 37 and 38 described heretofore. Reference numeral 40 in the figure depicts a metal bearing, which supports the rotary shaft 15, in conjunction with a similar metal bearing above, in such a way that the rotary shaft 15 is axially rotatable with respect to the outer pipe 14, that is, rotatable around its axis.

Figure 4:
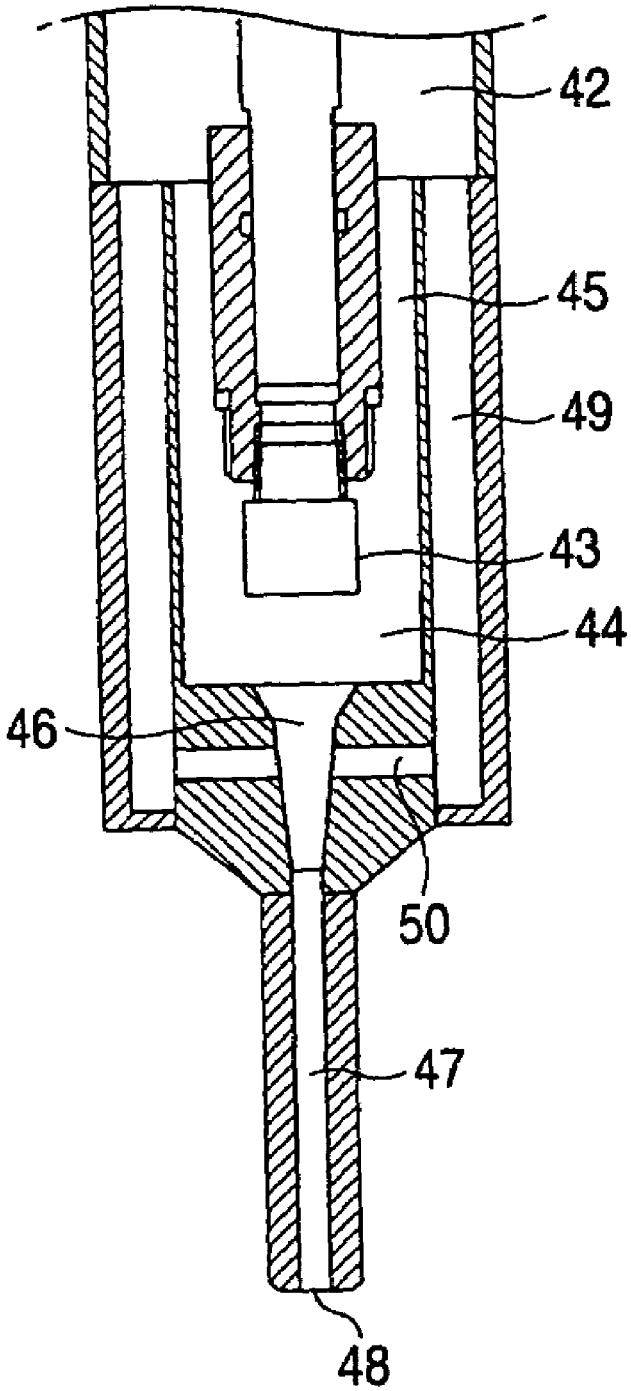
FIG. 4 is an enlarged sectional view showing a nozzle portion.

As described heretofore, the nozzle 29 is provided at the leading end of the revolving rotary shaft 28 and, as shown in FIG. 3, the nozzle 29 in the embodiment, being fixed to the leading end of the revolving rotary shaft 28, has formed inside it a liquid flow passage 41 and a gas flow passage 42 which communicate respectively with the liquid flow passage 34 and the gas flow passage 35 which are formed inside and outside the inner pipe 33. An ejection tip 43 is formed at a tip of the liquid flow passage 41, and the cleaning liquid is ejected in a flat shape into a space 44. FIG. 4 is an enlarged sectional view showing the nozzle 29 portion in a cross section perpendicular to the plane of FIG. 3. As shown in FIG. 4, the space 44 is in communication with the gas flow passage 42 via a communication path 45, wherein the gas flows into the space 44 under the ejection action based on an ejection of the cleaning liquid from the ejection tip 43, thereby forming a gas layer on the outer periphery of an ejection flow of the cleaning liquid from the ejection tip 43, and also allowing a gas-liquid mixing to progress gradually. The ejection flow having passed through the space 44 passes through a throttle 46, which is formed downstream of the space 44 and the sectional area of whose flow path is gradually reduced in two stages, and through a further downstream flat ejection flow path 47, thereby further promoting the gas-liquid mixing, and is then ejected from an ejection orifice 48 to the outside of the nozzle in the form of a flat gas-liquid mixture flow. In a case of the embodiment, furthermore, a gas supply path 50, which can suck the gas via a communication path 49 in communication with the gas flow passage 42, is connected to an intermediate portion of the throttle 46. The gas supply path 50 is intended for preventing liquid droplets in the ejection flow from making contact with an inner wall surface of the path, wherein an air layer is replenished on the outer periphery of the ejection flow passing through the throttle 46, suppressing an attenuation of the ejection flow as well. Because a smooth nozzle having the ejection flow path 47, which is flattened in a direction parallel to the revolving rotary shaft 28, is employed as the nozzle 29 in the embodiment, as a wide-ranging gas-liquid mixture flow is formed with respect to a rotation direction of the nozzle 29, it is possible to obtain a very efficient cleaning action.

In this way, as shown in FIG. 1, in the case in which an object to be cleaned 3 such as a tank is conveyed into the prescribed position inside the pedestal 2 via the conveyor 4, first, the drive cylinder 7 is driven to lower the whole internal cleaning apparatus 1 together with the outer pipe 14, causing the nozzle 29 portion to enter the interior of the internal space 51 of the object to be cleaned 3. Incidentally, in the event that the nozzle 29 stop position is previously set to a position in which the nozzle 29 is oriented upward, that is, in such a way that the nozzle 29, in the internal space 51 of the object to be cleaned 3, is oriented in the direction of the opening, not only is the nozzle 29 prevented from interfering with the conveyance of the object to be cleaned 3 into the pedestal 2, but also the nozzle 29 can be smoothly inserted into the internal space of the object to be cleaned 3. Then, when the nozzle 29 portion has been inserted in the internal space 51 of the object to be cleaned 3, as well as the motor 19 being driven to rotate the rotary shaft 15, a halfway valve 53 is opened to start a high pressure supply of the cleaning liquid from the cleaning liquid tank 25 via the pump 24. By this means, along with the rotation of the rotary shaft 15, as well as the revolving rotary shaft 28 starting to revolve about the rotary shaft 15, the revolving rotary shaft 28 starts to rotate axially due to the meshing engagement with the bevel gears 37 and 38. Consequently, the nozzle 29 starts to revolve about the rotary shaft 15 and revolve about the revolving rotary shaft 28, wherein, as well as the cleaning liquid pumped via the liquid flow passages 17, 34 and 41 being ejected from the ejection tip 43, a gas supplied from the exterior via the gas flow passages 18, 35 and 42 through the gas inflow opening 36 is mixed with the ejection flow of the cleaning liquid, and the flat gas-liquid mixture flow is ejected from the ejection orifice 48 of the flat ejection flow path 47, and is three-dimensionally sprayed all over the inner surface of the internal space 51 of the object to be cleaned 3, thus carrying out a reliable and efficient cleaning in every corner. In the embodiment, the cleaning liquid etc. used for the cleaning is caused to flow to the exterior from a drain outlet 52 formed in a lower portion of the object to be cleaned 3.

What is claimed is:

1. An internal cleaning apparatus comprising:

a rotary shaft having a liquid flow passage and being axially rotatable;

a revolving rotary shaft having a liquid flow passage connected to the liquid flow passage of the rotary shaft, being provided in a direction substantially perpendicular to the rotary shaft, and being revolvable about the rotary shaft and axially rotatable;

a nozzle being provided at a leading end of the revolving rotary shaft for ejecting a liquid, which is supplied from the liquid flow passage of the revolving rotary shaft, while revolving around the revolving rotary shaft; and a gas flow passage being provided along the liquid flow passage of each of the rotary shaft and the revolving rotary shaft from a gas inflow opening provided in the rotary shaft, wherein the nozzle comprises a smooth nozzle which is flattened in a direction parallel to the revolving rotary shaft, and nozzle comprising:

an ejection tip being provided at a tip of the liquid flow passage for ejecting the liquid; and a communication path communicating with the gas flow passage, and wherein a gas-liquid mixture flow, having a gas supplied from outside an object to be cleaned mixed with the liquid ejected from the ejection tip in the nozzle, is ejected from the nozzle.

2. The internal cleaning apparatus according to claim 1, wherein the nozzle is provided so as to be able to enter and retract from an interior of an internal space of the object to be cleaned, and wherein the internal cleaning apparatus further comprises a lid which closes an opening of the object to be cleaned when the nozzle has entered the interior of the internal space.

3. The internal cleaning apparatus according to claim 1, wherein the nozzle is oriented in a direction of the opening of the object to be cleaned when the nozzle is not revolving.

4. The internal cleaning apparatus according to claim 1, wherein the nozzle is insertable into an internal space of the object to be cleaned so as to clean an interior of the object to be cleaned.

5. The internal cleaning apparatus according to claim 1, further comprising a gas supply path being provided on an inner wall surface of the nozzle for communicating with the gas flow passage.

6. The internal cleaning apparatus according to claim 5, wherein the gas supply path is provided downstream of an ejection flow ejected from the ejection tip.

* * * * *